US005720546A

United States Patent [19]

Correll, Jr. et al.

[11] Patent Number: 5,720,546

[45] Date of Patent: Feb. 24, 1998

[54] INTEGRATED BALLAST AND LAMP CONNECTOR

[75] Inventors: Robert Stewart Correll, Jr., Harrisburg; Earl William McCleerey, Mechanicsburg, both of Pa.

[73] Assignee: The Whitaker Corp. Wilmington, Del.

[21] Appl. No.: 641,072

[22] Filed: Apr. 26, 1996

Related U.S. Application Data

[63] Continuation of Ser. No. 309,300, Sep. 20, 1994, abandoned.

[51] Int. Cl.[6] ..... H01R 33/08; F21S 3/00

[52] U.S. Cl. ..... 362/221; 362/225; 362/260; 439/56; 439/235

[58] Field of Search ..... 362/221, 219, 362/225, 260, 362; 439/235, 76.1, 465, 441, 460, 404, 417, 468, 56–58

[56] References Cited

U.S. PATENT DOCUMENTS

| | | | |
|---|---|---|---|
| Re. 30,367 | 8/1980 | Belokin, Jr. | 439/235 |
| 4,092,562 | 5/1978 | Campbell | 315/189 |
| 4,149,226 | 4/1979 | Dalton | 362/216 |
| 4,204,139 | 5/1980 | Shimer et al. | 315/58 |
| 4,407,011 | 9/1983 | Lahm | 362/150 |
| 4,449,071 | 5/1984 | Yokoyama | 315/53 |
| 4,504,891 | 3/1985 | Mazis | 362/219 |
| 4,645,974 | 2/1987 | Asai | 315/50 |
| 4,680,677 | 7/1987 | Ross | 362/33 |
| 4,683,402 | 7/1987 | Aubrey | 315/56 |
| 4,729,740 | 3/1988 | Crowe et al. | 439/76 |
| 4,792,726 | 12/1988 | Gandhi | 315/52 |
| 4,952,899 | 8/1990 | Kulka et al. | 336/160 |
| 5,006,764 | 4/1991 | Swanson et al. | 315/276 |
| 5,013,253 | 5/1991 | Aiello et al. | 439/235 |
| 5,023,520 | 6/1991 | Costa | 315/276 |
| 5,039,915 | 8/1991 | Lu | 362/362 |
| 5,138,528 | 8/1992 | Altman et al. | 361/400 |
| 5,168,422 | 12/1992 | Duncan | 361/377 |
| 5,226,724 | 7/1993 | Kanarek | 362/260 |
| 5,260,678 | 11/1993 | Van Wagener et al. | 336/96 |
| 5,309,061 | 5/1994 | Bouchard et al. | 315/47 |
| 5,315,211 | 5/1994 | Ditlevsen et al. | 315/50 |
| 5,324,213 | 6/1994 | Frantz | 439/441 |
| 5,331,250 | 7/1994 | Ravi et al. | 315/71 |
| 5,492,485 | 2/1996 | Drewanz et al. | 439/404 |

FOREIGN PATENT DOCUMENTS

| | | | |
|---|---|---|---|
| 2225100 | 5/1990 | United Kingdom | 362/260 |

*Primary Examiner*—Ira S. Lazarus
*Assistant Examiner*—Matthew Spark
*Attorney, Agent, or Firm*—Robert J. Kapalka

[57] ABSTRACT

An electrical connector (3) for a fluorescent lighting fixture (1) comprises a circuit board (9) having an integral lamp ballast (10), a first bank of sockets (4) and wire connecting ports (11,12). A housing (16) encloses the ballast and the circuit board. The first bank of sockets are exposed from the housing for connection to fluorescent lamps, and the wire connecting ports are exposed from the housing for connection between external wiring from a source of electrical power and wiring extending to a second bank of sockets for the fluorescent lamps.

22 Claims, 8 Drawing Sheets

INTEGRATED BALLAST AND LAMP CONNECTOR

This application is a Continuation of application Ser. No. 08/309,300 filed Sep. 20, 1994, now abandoned.

FIELD OF THE INVENTION

The invention pertains to an electrical connector for fluorescent lamps, and more particularly, to connection of an electrical ballast and sockets for multiple fluorescent lamps.

BACKGROUND OF THE INVENTION

An integral unit for a fluorescent lamp and a ballast is known from U.S. Pat. No. 4,204,139, and comprises, a single fluorescent lamp, the opposite ends of which are connected, respectively, into an end cap and into another end cap containing a ballast for the lamp. The end caps are connected by a support extending along a length of the lamp. The unit is intended for plugging directly into an ordinary electrical outlet. The ballast comprises, a choke, a preheat ballast starter and a circuit breaker.

Another integral unit, known from U.S. Pat. No. 4,792,726, is intended to fit into a lamp socket for an ordinary incandescent light bulb, and comprises, a ballast and a fluorescent lamp with wire ends interconnected within a single bulb. The bulb is intended to replace an ordinary incandescent light bulb.

U.S. Pat. No. 5,138,528, discloses a fluorescent lighting fixture that comprises, two banks of fluorescent lamp sockets that are on opposite sides of a reflector housing for connection to opposite ends of at least one fluorescent lamp, electrical connections for external wiring supplying electrical power, and multiple conductors interconnecting both banks of sockets with an electrical ballast for starting each fluorescent lamp.

U.S. Pat. No. 4,504,891 discloses a fluorescent lamp system in which two lamp socket bars contain a circuit board that provides all circuit wiring for fluorescent lamps except for separate plug-in ballasts that are plugged-in to the bars, and for plug-in wiring that is plugged-in to interconnect the two bars.

U.S. Pat. No. 4,729,740 discloses a ballast on a circuit board together with electrical connector blocks to which wires are plugged-in, the wires being adapted to interconnect the ballast with other electrical devices in a fluorescent lighting fixture.

SUMMARY OF THE INVENTION

The invention is particularly adapted for a fluorescent lighting fixture having two banks of sockets for connection to opposite ends of at least one fluorescent lamp, for example, as disclosed in the above referenced U.S. Pat. No. 5,138,528.

The invention resides in an electrical connector integrating an electrical ballast, a bank of electrical sockets adapted to connect with one end on each of at least one fluorescent lamp, and a wire connection port adapted to connect a wire with an additional bank of electrical sockets for opposite ends of each lamp, and another wire connection port adapted to connect with external wiring supplying electrical power.

An advantage of the invention allows a lighting fixture with an ineffective or defective ballast to be repaired as well as rewired by replacing solely one bank of fluorescent lamp sockets.

Another advantage of the invention resides in a connector that integrates one bank of fluorescent lamp sockets, a ballast and wire connecting ports, which facilitate connection of a single wire used to interconnect a second bank of fluorescent lamp sockets in a new or existing lighting fixture.

Another advantage of the invention resides in an electrical connector to be mounted on a lighting fixture that integrates one bank of fluorescent lamp sockets with a ballast, which facilitates connection of a second bank of fluorescent lamp sockets on the fixture directly to the electrical connector, and bypassing a connection to a separate ballast.

An embodiment of the invention resides in an electrical connector to be mounted on a lighting fixture that integrates one bank of fluorescent lamp sockets with a ballast, and with wire gripping connector blocks for ease in connecting the ballast with wires supplying electrical power, as well as with at least one other wire supplying an electrical connection of the connector with a second bank of fluorescent lamp sockets on the lighting fixture.

An embodiment of the invention will now be described by way of example with reference to the accompanying drawings, according to which;

DETAILED DESCRIPTION

Figure 1:
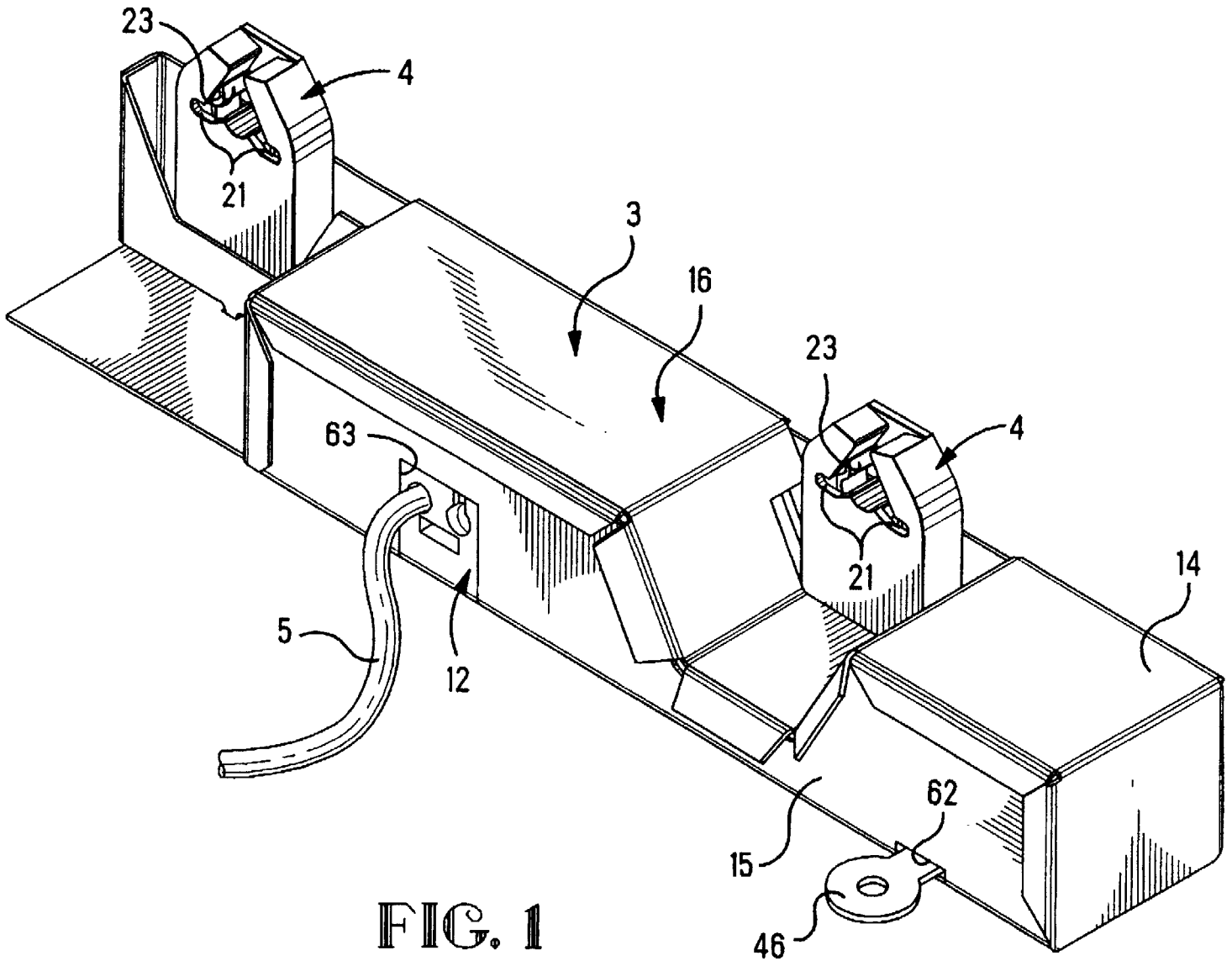
FIG. 1 is an isometric view of an electrical connector integrating a bank of fluorescent lamp sockets, a ballast and wire gripping, electrical contacts adapted to connect with respective wires that interconnect the connector and a second bank of lamp sockets.
Figure 2:
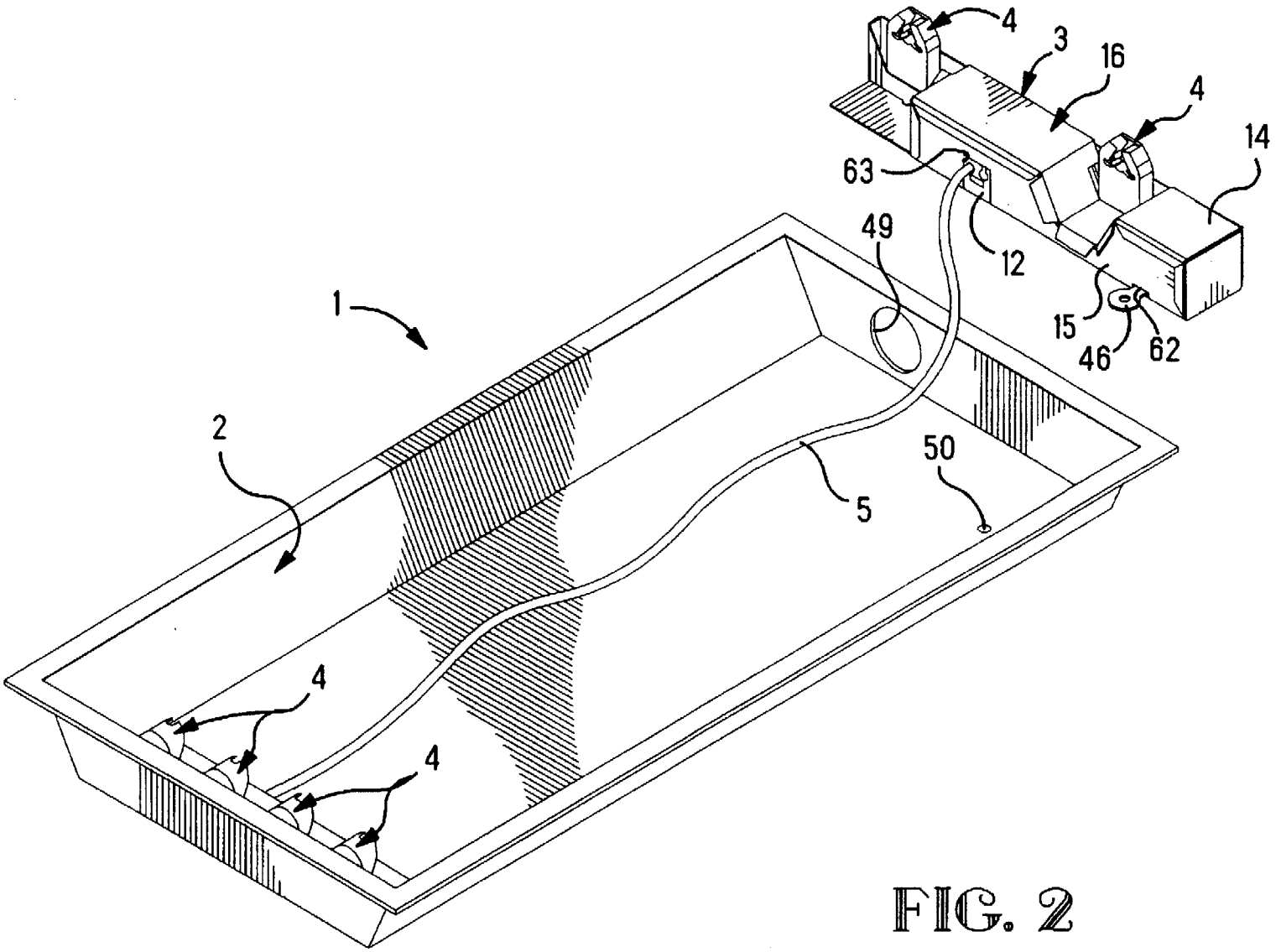
FIG. 2 is an isometric view of an electrical connector as shown in FIG. 1 together with a fluorescent lighting fixture.

With reference to FIGS. 1 and 2, a lighting fixture 1 comprises, a reflector housing 2, also known as, a troffer, an electrical connector 3 for mounting to one side of the housing 2, a bank of fluorescent lamp sockets 4 on the connector 3, and a second bank of fluorescent lamp sockets 4 for mounting on an opposite side of the housing 2. At least one insulated wire 5 interconnects the two banks of sockets 4. Although only one connector 3 is shown in FIG. 1, a number of connectors 3 can be used to provide a larger number of sockets 4. Alternatively, the connector 3 can be increased in size to provide a larger number of sockets 4.

Figure 12:
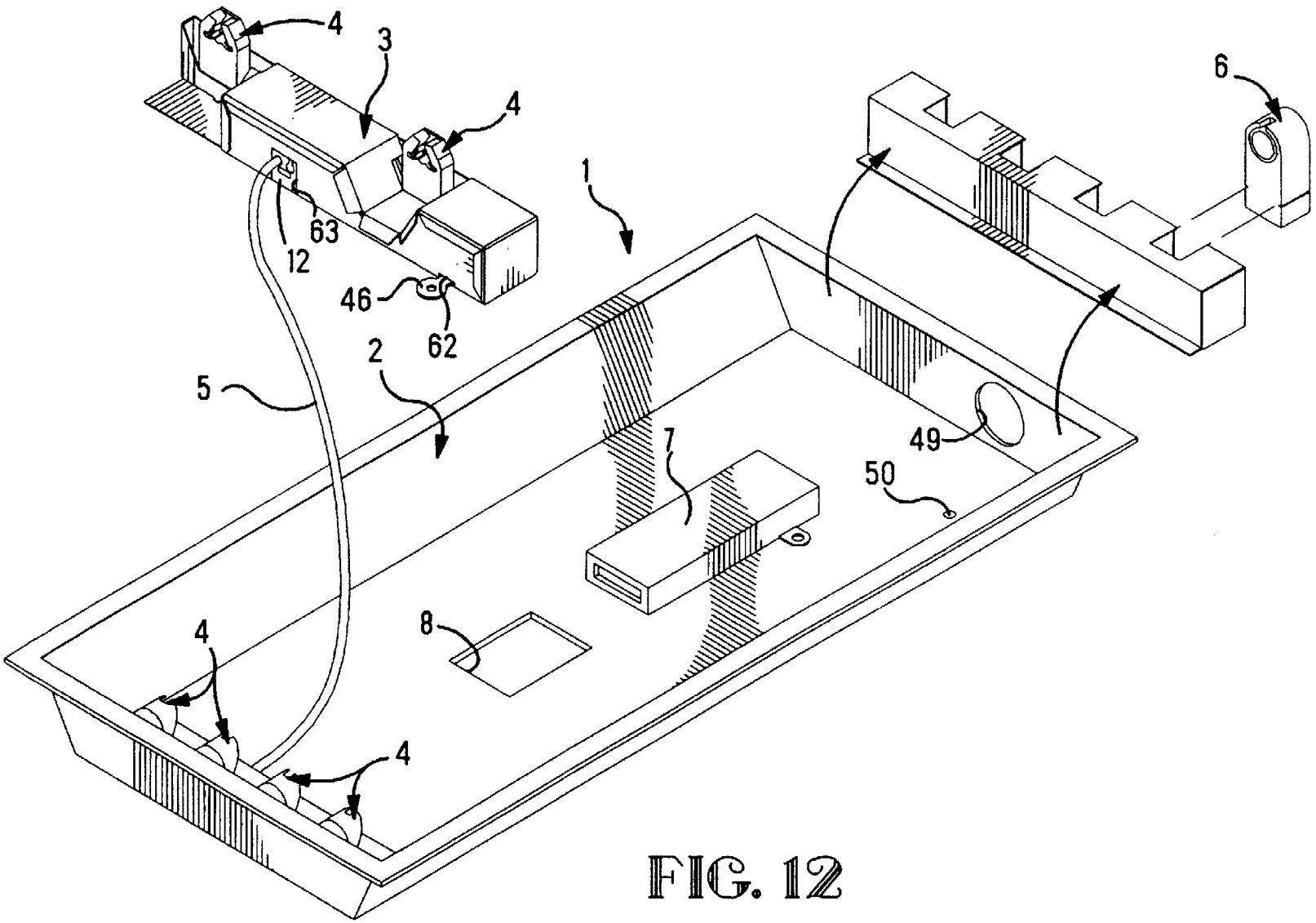
FIG. 12 is an isometric view of a known lighting fixture.

With reference to FIG. 12, an alternative lighting fixture 1 comprises; a separate fluorescent lamp socket 6, a separate fluorescent lamp ballast 7 mounted on a bottom side of the fixture 1, and a knock out portion 8 of the bottom side that is defined by score lines through the thickness of the bottom side, and that can be removed by prying until the score lines sever. The knock out portion 8 is removed to provide at least one opening for admitting wiring, not shown, supplying electrical power to the separate ballast 7 and to each fluorescent lamp socket 6. The wiring, not shown, is commonly used in the industry, and comprises, a current carrying wire, black in color, a neutral or return wire, white in color, and an uninsulated ground wire, in a wiring system known as an insulated two-conductor and an uninsulated ground. The wiring also may comprise, in addition to the black and white wires, a third insulated ground wire, green in color, in a wiring system known as a three-wire plus uninsulated ground. When the separate ballast is provided, the second bank of sockets are connected to the separate ballast by wires, as in U.S. Pat. No. 4,504,891, or by flat conductors according to U.S. Pat. No. 5,138,528.

Figure 3:
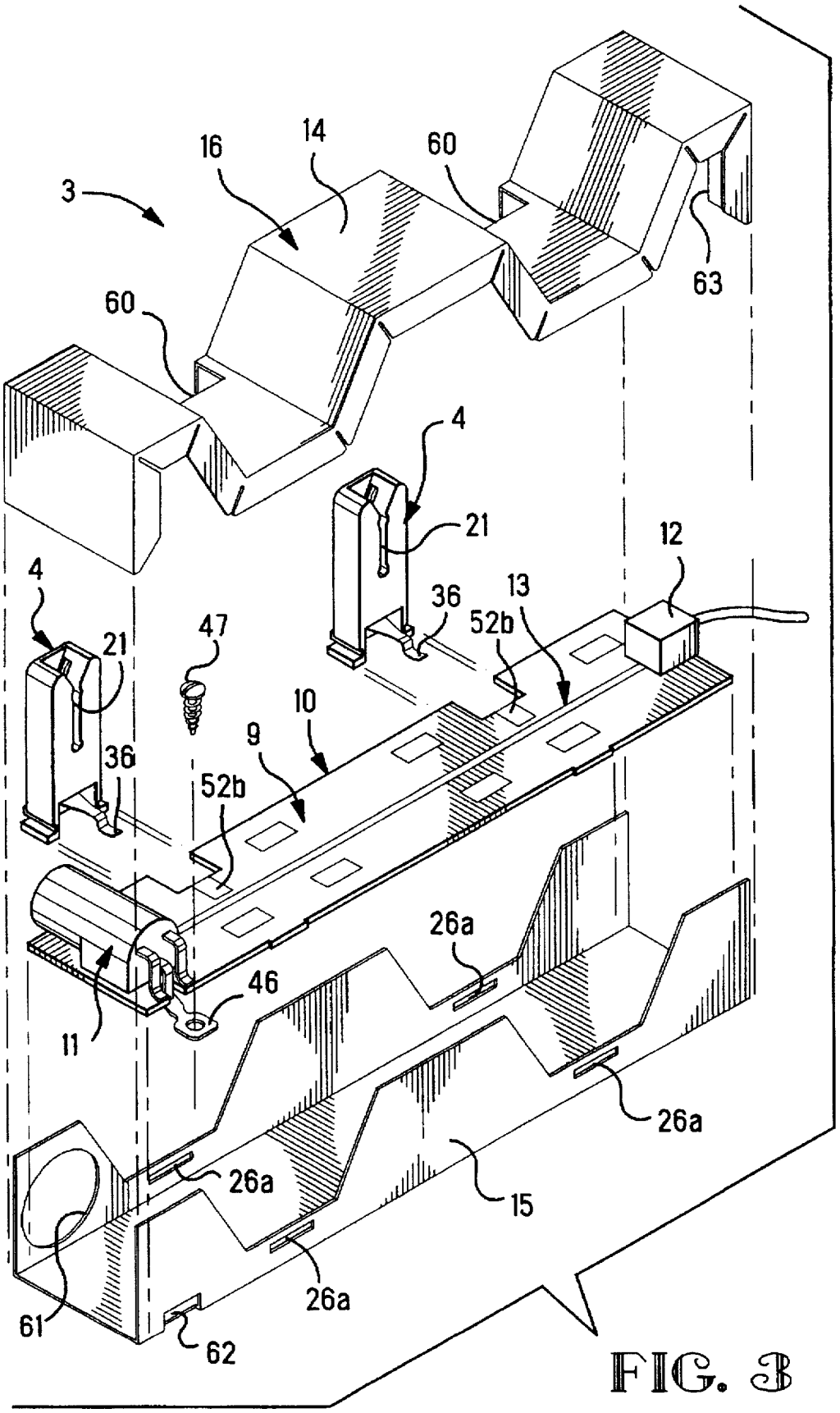
FIG. 3 is an isometric view of the electrical connector as shown in FIG. 1 with component parts separated from one another.

With reference to FIGS. 2 and 3, the electrical connector 3 comprises, a circuit board 9, the bank of fluorescent lamp sockets 4 for connection of fluorescent tube lamps, not shown, at least one electronic ballast 10, having different components, an external power connector block 11 comprising a wire connecting port, and an internal connector block 12 comprising another wire connecting port. A feature of the invention resides in an integrated circuit 13 on the circuit board 9 that integrates into a unit, the electronic ballast 10, the sockets 4 and the connector blocks 11, 12. Metal covers 14, 15 close together and form a housing 16 enclosing the circuit board 9 and the integrated circuit 13 and each ballast 10. The circuit board 9 insulates the housing 16 from contact with the integrated circuit 13. The housing 16 has a spacious interior that encloses each ballast 10, and is spaced apart from each ballast 10.

Figure 4:
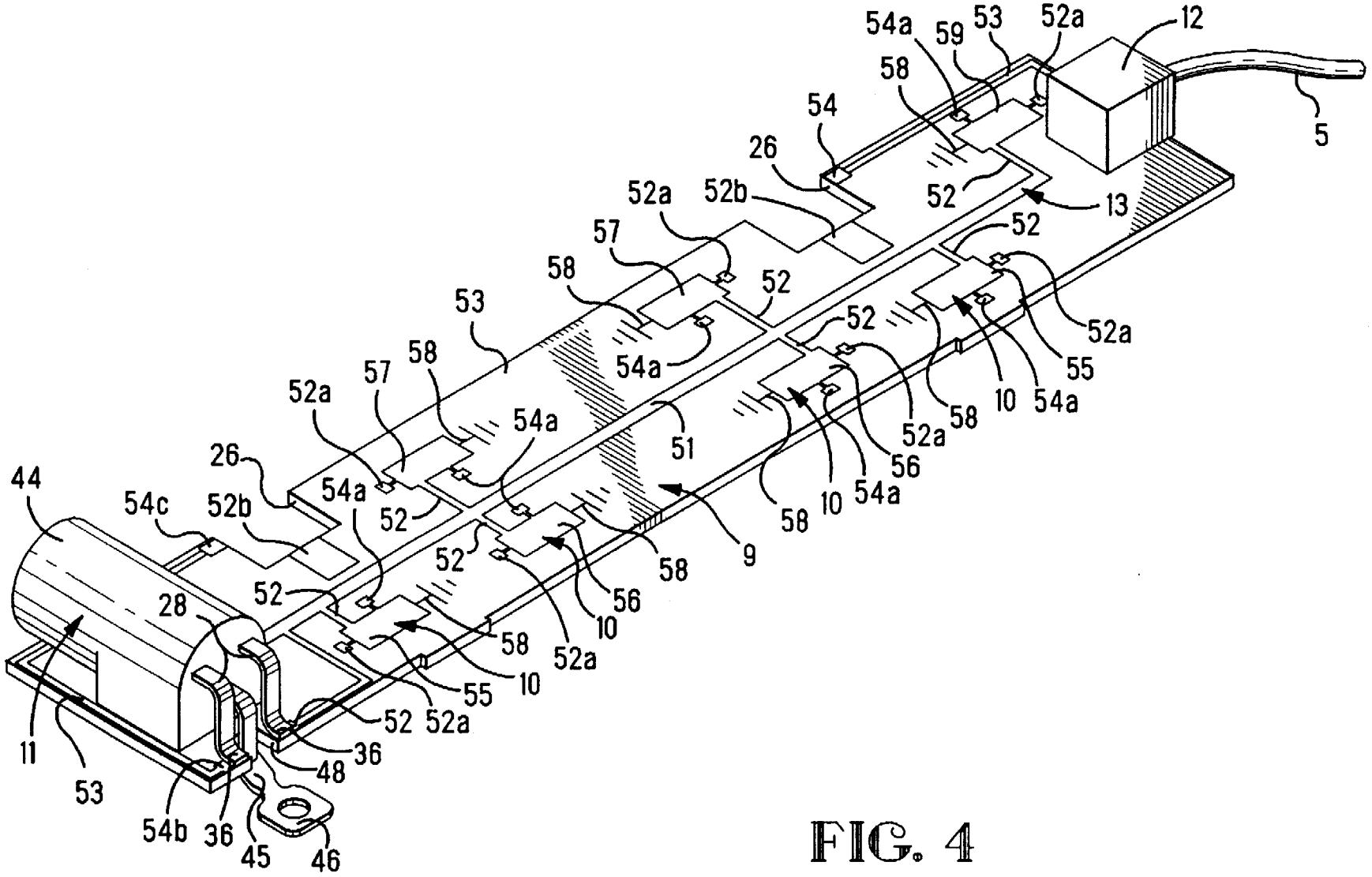
FIG. 4 is an isometric view of a circuit board.
Figure 5:
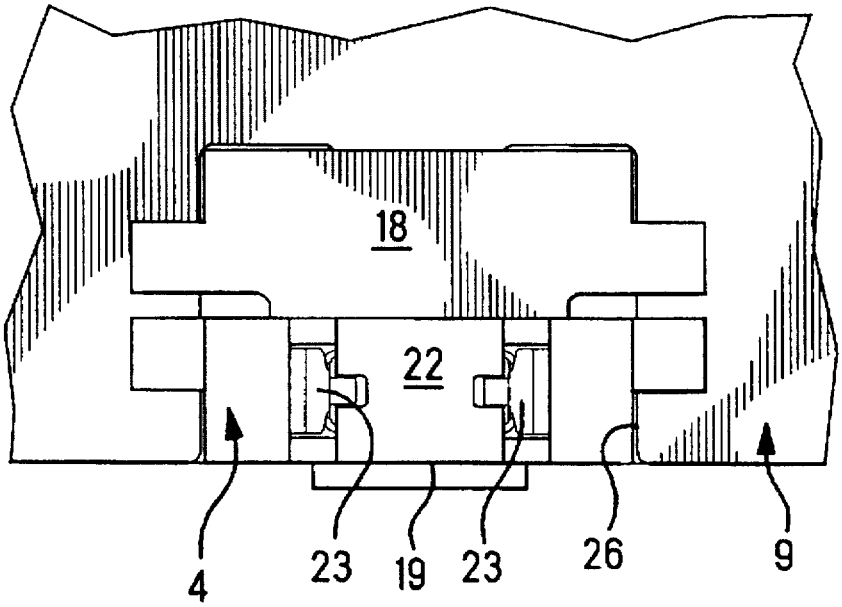
FIG. 5 is a top view of a fluorescent lamp socket in the connector as shown in FIG. 3.
Figure 6:
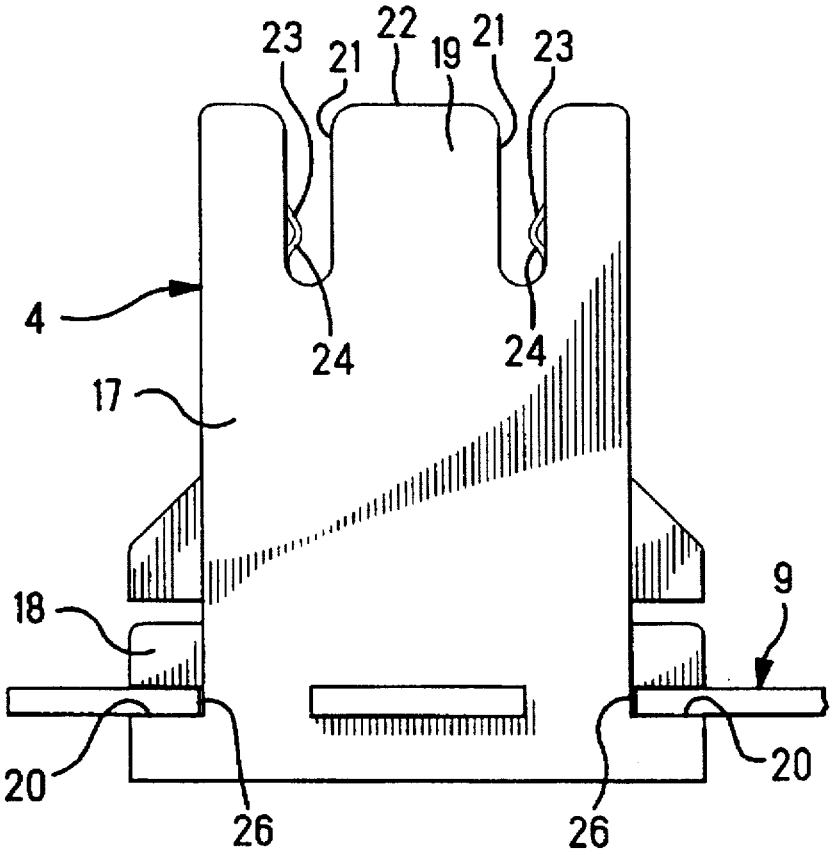
FIG. 6 is a front elevation view of the socket as shown in FIG. 4.
Figure 7:
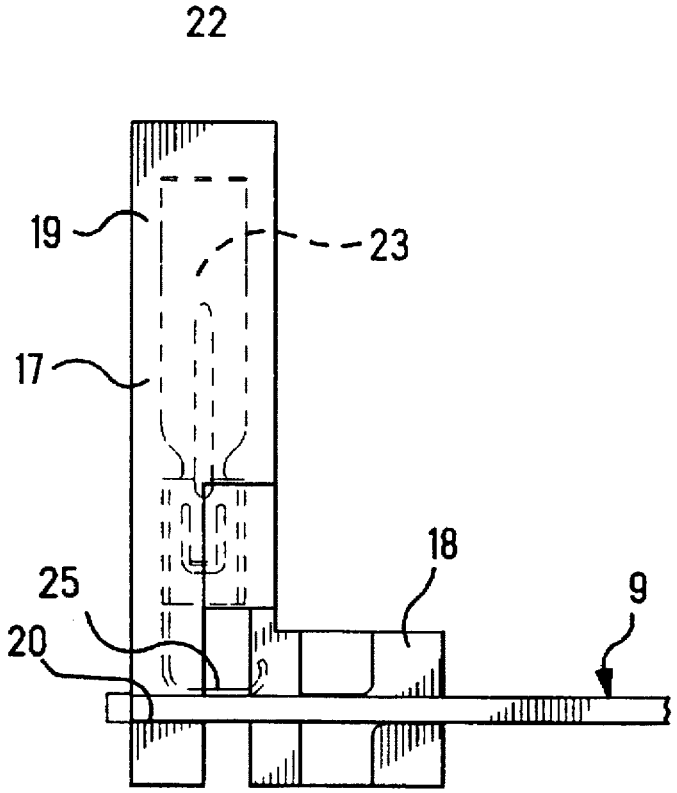
FIG. 7 is a side elevation view of the socket as shown in FIG. 4.
Figure 8:
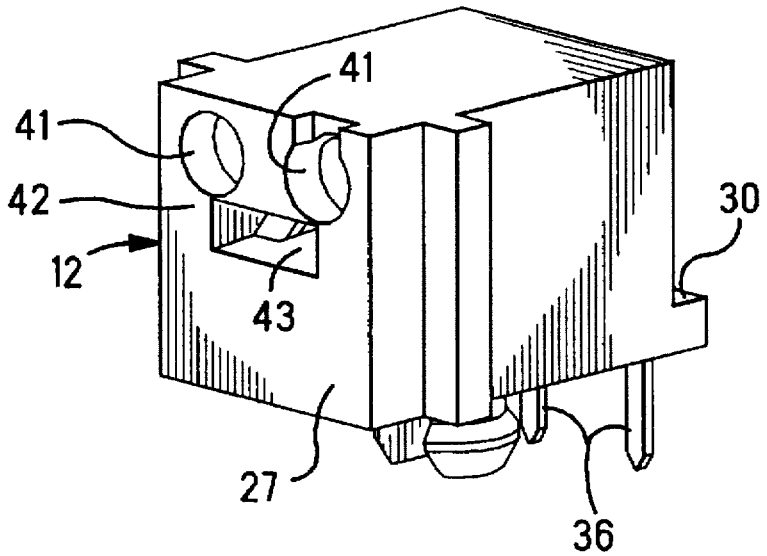
FIG. 8 is an isometric view of wire connection port in the connector as shown in FIG. 3.
Figure 9:
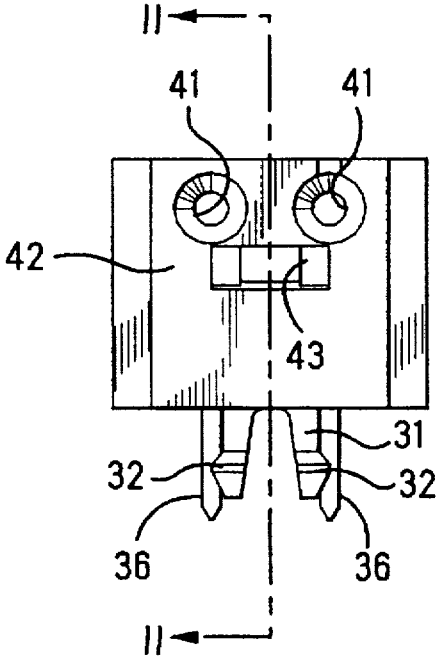
FIG. 9 is a front view of the port as shown in FIG. 8.
Figure 10:
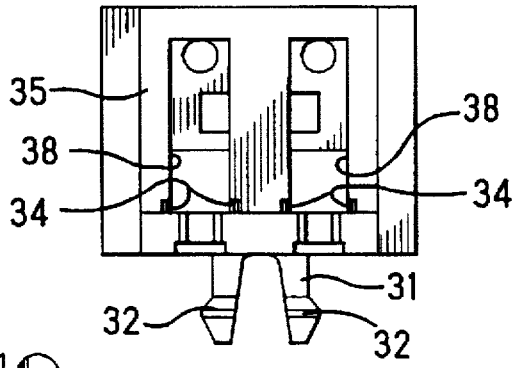
FIG. 10 is a rear view of the port as shown in FIG. 8.

With reference to FIGS. 5–7, each of the sockets 4 will now be described. A unitary insulative housing 17 is fabricated with a base 18 and a bracket 19 extending from the base 18. The base 18 is partially circumscribed by a circuit board receiving groove 20. Prong receiving openings 21 in a free end 22 of the bracket 19 extend toward the base 18. The openings 21 are two separate openings 21, FIGS. 2 and 12, or are combined into a single opening 21, FIG. 3. Two conductive spring bladed electrical contacts 23 are stamped and formed from one common metal strip and extend beside respective openings 21. A well known, fluorescent lamp, not shown, has conductive prongs that are plugged into, and inserted along, the prong receiving openings 21 to facilitate electrical connection of the prongs of the lamp to respective contacts 23 of a corresponding socket 4. The contacts 23 have detents 24 that receive the prongs on the fluorescent lamp to establish an electrical connection with the lamp. The prongs are electrically commoned by the contacts 23, when the contacts are connected to the circuit board 9 in a manner to be described. The contacts 23 extend toward the base 18. Terminals 25 on the contacts 23 extend along an imaginary plane that extends along the groove 20 in the base 18. With reference to FIG. 3, each socket 4 is received in a recess 26 in the circuit board 9, each recess 26 defining a socket receiving area. An edge of the circuit board 9 along the recess 26 is received in the groove 20 in the base 18 of the socket 4 to support the socket 4 on the circuit board 9. Edges of the circuit board 20 are supported in a series of slots **26*a* through the housing 17. The exterior shape of the housing 17 can be changed to accommodate a desired appearance. For example, the shape of each housing 17 shown in FIGS. 3–7 is generally rectangular at an end, while the shape of each housing 17 shown in FIGS. 1, 2 and 12 is more tapered at the end. The circuit board 9 can be readily changed to add additional sockets 4, onto the circuit board 9, and to add additional capacity and components comprising the ballast 10** that will be needed to operate additional fluorescent lamps, not shown.

With reference to FIGS. 8–11, the internal connector block 12 will now be described. The internal connector block 12 comprises, an insulating housing 27 and wire connecting, conductive electrical contacts 28 in respective contact receiving cavities 29 in the housing 27. The housing 27 is of unitary molded construction, and comprises a base 30 for mounting to the circuit board 9, and a unitary fastener 31 constructed with two resiliently deflecting locking fingers with ridges 32. The locking fingers project from the base 31 to enter into, and to lock the ridges 33 in, an opening, not shown, in the circuit board 9.

Figure 11:
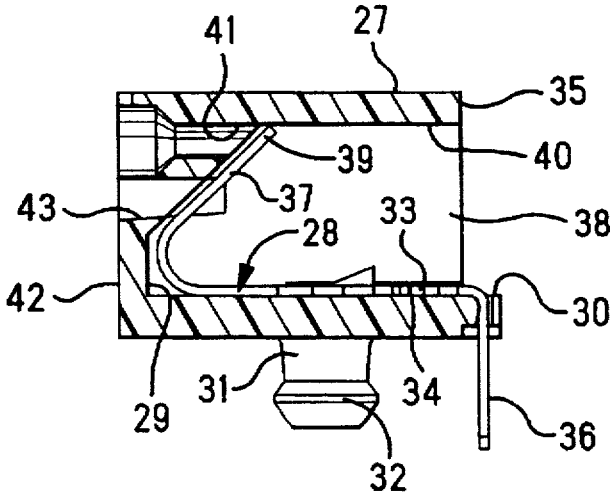
FIG. 11 is a section view taken along the line 10—10 of FIG. 9.

With reference to FIGS. 8–11, each contact 28 is of unitary construction, stamped and formed from a strip of metal having a plane of thickness. Each contact 28 has a flat base 33 that is slid along a thin slot 34, FIG. 10, in an end 35 of the housing 17. The slot 34 restrains movement of the base 33. An electrical terminal 36 on the contact 28 extends from the base 33, and is bent downward to project below the base 30 of the housing 27 for connection to the circuit board 9 on which the base 30 is mounted. A curved spring contact portion 37 of the contact 28 extends upward from the base 33, and is slid along an opening 38, FIGS. 10 and 11, in the end of the housing 27. The contact portion 37 is narrower than the wider base 33. The opening 38 is narrower than the wider slot 34. The opening 38 communicates with the slot 34. A tip 39 of the contact portion 36, FIG. 11, is opposite an interior wall 40 in the cavity 29 in the housing 27. A wire receiving opening 41 through a side wall 42 of the housing 27 is aligned with the interior wall 40, and intercepts the contact portion 37. A wire removal slot 43 through the side wall 42 is adjacent the wire receiving opening 41, and intercepts the contact portion 37.

With reference to FIGS. 8–11, at least one insulated wire 5 can be inserted along the wire receiving opening 41, deflecting the spring contact portion 37 resiliently, such that stored spring energy in the deflected contact portion 37 will cause the contact portion 37 to press against the wire 5 while the wire 5 is trapped against the interior wall 40. The wire 5 is then electrically connected to the contact 28 merely by poking the wire 5 into and along the wire receiving opening 41. This type of connector block 12 comprises, a wire connecting port in the form of a poke home type connector, and the contacts 28 comprise, poke home type contacts 28. To remove the wire 5, a blade of a screwdriver, not shown, can be inserted into the wire removal slot 43 to deflect the contact portion 37 away from the wire 5, thereby freeing the wire 5 for removal from the wire receiving opening 41. The wire 5 is then connected in a known manner to the second bank of sockets 4, FIGS. 2 and 12, on the other side of the reflector housing 2 away from the connector 1.

The circuit board 9 can be readily changed to adjust the positions of the sockets 4, the position of the internal connector block 12 and position of the external power connector block 11. For example, the position of the internal connector block 12 on the circuit board 9 can be moved from an end of the circuit board 9, as shown in FIG. 3, to a position in the center of the circuit board 9, between two sockets 4, as shown in FIGS. 2 and 12. With reference to FIGS. 2 and 11, the internal connector block 12 is used to connect a single insulated wire 5 to a second bank of additional fluorescent sockets 4 on the other side of the reflector housing 2. Although a single wire 5 is shown for connection to the second bank of additional sockets 4, two wires 5 can be used, because the internal connector block 12 is shown with two duplicated contacts 28 in two duplicated cavities 29 in the housing 27 for connection of two wires 5. By providing any number of multiple duplicated contacts 28 and corresponding multiple duplicated cavities 29 in the housing 27, a corresponding multiple number of wires 5 can be connected to the duplicated contacts 28, and then to the second bank of sockets 4 on the other side of the reflector housing 2. In addition, the duplicated contacts 28 and corresponding duplicated contact receiving cavities 29 can be provided in the external power connector block 11.

With reference to FIGS. 3 and 4, the external power connector block 11 will now be described. The external power connector block 11 comprises an insulating housing 44 containing three contacts 28, and corresponding duplicated contact receiving cavities 29, not shown, receiving the contacts 28. The housing 44 of the power connector block 11 has a different exterior shape than the housing 27 of the internal connector block 12, to distinguish the two from each other, and to accommodate different sizes of wires. Terminals 36 on the two contacts 28 project out of the housing 44 for connection to the circuit board 9, in a manner to be described. The contacts 28 are adapted to be connected to insulated wires, not shown, of external wiring, not shown, that supplies electrical power to the connector 3. The external power connector block 11 comprises, a wire connecting port in the form of a poke home type connector, and the contacts 28 comprise, poke home type contacts 28. The wire connecting contacts 28 in both of the connector blocks 11, 12 are adapted to connect the sockets 4 and each ballast 10 and the connector blocks 11, 12 between external wiring, not shown, and the additional bank of fluorescent lamp sockets 4, FIGS. 2 and 12, by the single wire 5.

As shown in FIG. 12, the internal connector block 12 facilitates the single wire 5 to interconnect the second bank of sockets 4 to the connector 3 directly, and bypassing the separate ballast 7 that can be inadequate or defective. The connector is adapted to replace one of the banks of sockets 4, thus, to repair, and to rewire, a lighting fixture 1 that exists with an inadequate or defective ballast 7. An inadequate ballast 7 is one which is constructed with devices, such as a choke and a circuit breaker and non-electronic impedance controls, which are costly in electrical power consumption. An electronic ballast 10 eliminates such power consuming devices, is less costly to operate and is less susceptible to overheating and other defects. In addition, an electronic ballast 10 incorporates noise suppression and shielding to eliminate RFI and EMI interference.

With reference to FIGS. 3 and 4, a separate, conductive ground terminal 45 on the connector block 11 is attached, for example, by being imbedded in the housing 44, and is attached to a conductive ring 46 that receives and encircles a self-threading ground screw 47. The ring 46 and the terminal 45 extend through an opening 48 through the circuit board 9 and avoid connection to the circuit board 9. A safety code requirement does require an electrical ground of the power connector block 11 and the reflector housing 2, FIGS. 2 and 11, to a ground wire, not shown, of the wiring, not shown, that supplies electrical power. For example, the ground wire can be an uninsulated ground wire or an insulated green ground wire, for example. Additionally, the safety code requirement does require the wiring to enter an opening 49 in the reflector housing 2, FIGS. 2 and 12, and to be anchored at the opening 49, according to a known practice.

The ground wire is connected by insertion into the ground contact 28 that is associated with the ring 46. This ground contact 28 uses the ring 46 and the ground screw 47 to connect and ground the connector 3 to the fixture 1. This allows an installer to assure ground continuity of the wiring with the fixture 1, without opening the fixture 1 or the connector 3 at a building site where the fixture is installed.

With reference to FIGS. 3 and 4, the integrated circuit 13 will be described. The circuit board 9 comprises an insulating substrate on which is the integrated circuit 13, shown in schematic form. As shown in FIG. 3, each of the sockets 4 is shown in a position prior to being received by a socket receiving recess 26. For the purpose of illustration, the integrated circuit 13 is on an exterior surface of the circuit board 9. The integrated circuit 13 can be constructed in different layers inside the circuit board 9, in accordance with a construction known as a multilayer circuit board 9.

With reference to FIGS. 3 and 4, a relatively wide, power bus 51 is a portion of the circuit 13. Conductive pads 52 on the power bus 51 are conductive areas of the integrated circuit 13. The power bus 51 provides an electrical bus that interconnects the ballast 10 and input power from the power connector 11. With reference to FIGS. 3 and 4, a corresponding pad 52 on the power bus 51 is adjacent to the external power connector 11. One of the terminals 36 engages the corresponding pad 52 to enable a known soldering operation to apply a solder joint, not shown that connects the terminal 36 directly to the corresponding pad 52. The terminal 36 connects the power bus 51 to the appropriate wire, not shown, providing input power, as above described.

With reference to FIG. 4, a relatively wide, neutral bus 53 is a portion of the integrated circuit 13. The neutral bus 53 is omitted in FIG. 3 for purposes of clarity. With reference to FIGS. 3 and 4, the internal connector block 12 is mounted on the circuit board 9, with at least one of the terminals 36 associated with the internal connector block 12 being connected by a solder joint, not shown, to another corresponding pad, not shown, on the neutral bus 53. The sockets 4 on the other side of the reflector housing 2 are connected to the neutral bus 53, as follows. Each of the terminals 36 of the connector block 12 that is connected to the neutral bus 53 is connected also to a corresponding insulated wire 5 that is used to connect with the bank of fluorescent sockets 4 on the other side of the reflector housing 2 of the fixture 1. Thereby, the neutral bus 53 provides an electrical return path that interconnects the sockets 4 on the other side of the fixture 1 and the connector block 12.

With reference to FIG. 4, a conductive pad 54 on the neutral bus 53 is a conductive area of the circuit 13 that connects a top surface of the circuit board 9 with an interior layer of the circuit board 9, not shown. The neutral bus 53 extends from the connector block 12, and along the top surface of the circuit board 9 where it intersects the pad 54. The pad 54 extends the neutral bus 53 into the interior layer of the circuit board 9.

With reference to FIGS. 3 and 4, the electronic ballast 10 will now be described. The integrated circuit 13 on the circuit board 9 integrates the electronic ballast 10 comprising one or more components, for example, components 55, 56, 57 in the integrated circuit 13. The components 55, 56, 57, are distributed in among the connector blocks 11, 12 and the sockets 4 and the power bus 51 and the ground bus 53, and within the interior of the housing 16. The electronic ballast 10 can comprise three or any number of such components 55, 56, 57, distributed along the power bus 51 of the integrated circuit 13. Additionally, any number of components 56, 57, and 58 of the ballast 10 can be distributed among the sockets 4 and the connector blocks 11, 12 within the interior of the housing 16.

One such component 55 is a voltage rectifier and regulator circuit that will convert AC voltages to DC pulses, and will supply start-up voltage and running voltage to each of the sockets 4 on the circuit board 9 to start-up and illuminate fluorescent lamps, not shown, plugged into respective sockets 4 on the circuit board 9. The other ends of the lamps are connected to respective sockets 4 on the other side of the fixture 1, returning to the ballast 10 via the neutral bus 53. In turn, each wire 5 provides electrical connection of the respective sockets 4 on the other side of the fixture 1 to the neutral bus 53.

Another such component 56 is a noise suppression circuit to suppress EMI and RF voltages generated during operation of the integrated circuit 13 and the fluorescent lamp. Another such component 57 is an impedance control circuit that will operate to distribute the electrical load among the multiple sockets 4 and the fluorescent lamps, not shown, that are plugged into the sockets 4. For the purpose of illustration, three of the components of the ballast 10 are shown. The ballast 10 can be improved and modified with various constructions, involving different types and different numbers of the components 56, 57 and 58. The components 56, 57 and 58 are illustrated with a low height above the circuit board 9. The height of the components of the ballast can vary.

The ballast 10, comprising the components 56, 57, 58, is connected in the circuit 13 between the power bus 51 and each of the sockets 4 mounted to the circuit board 9. Since the ballast 10 is in the circuit 13 between the power bus 51 and the sockets 4 mounted on the circuit board 9, an electrical connection between the ballast 10 and each of the sockets 4 is required. Thus, corresponding pads 52 on the power bus 51 connect the components 56, 57, 58 to the power bus 51. The ballast 10 can change to not require each of the components 56, 57 58 to connect with the power bus 51, which would eliminate the need for each component 56, 57 58 to connect with a corresponding pad 52. Each of the components 56, 57, 58 is connected to a corresponding pad **52*a* that is a conductive area of the circuit 13. Corresponding pads 52*a* extend into the circuit board 9 and along an interior layer, not shown, of the circuit board 9 until connecting with corresponding pads 52*b* adjacent the recesses 26**.

The contacts 28 that are associated with prongs of the same fluorescent tube are commoned electrically when connected to a single pad **52*b*. As shown in FIG. 3, one each of the terminals 36 on the corresponding sockets 4 is shown in a position prior to being connected directly to a corresponding pad 52*b*. When each of the sockets 4 is received by a corresponding socket receiving area, the terminal will engage the corresponding pad 52*b* to enable a known soldering operation to apply a solder joint, not shown that connects the terminal 36 directly to the corresponding pad 52*b***.

The ballast 10, comprising the components 56, 57, 58, is connected in the circuit 13 along the neutral bus 53 between the internal connector block 12 and the power connector block 11. Thus, each of the components 56, 57, 58 is connected to a corresponding pad **54*a* that is a conductive area of the circuit 13. Corresponding pads 54*a* extend into the circuit board 9 and along an interior layer, not shown, of the circuit board 9 until connecting with the pad 54 on the neutral bus 53. Although each of the components 56, 57, 58 is connected to the neutral bus 53, the ballast 10 may change to not require each of the components 56, 57, 58 to connect with the neutral bus 53, which would eliminate the need for each component 56, 57, 58 to connect with a corresponding pad 54*a***.

The ballast 10, comprising the components 56, 57, 58, is further connected to the power connector block 11. Thus, each of the components 56, 57, 58 is connected to a neutral pad 58, shown schematically as a conductive area of the circuit 13 that extends from a top surface of the circuit board 9 to an interior layer, not shown, of the circuit board. A corresponding pad **54*b* on the neutral bus 53 is a conductive area of the circuit 13, and is adjacent to the external power connector block 11. One of the terminals 36 associated with the external power connector block 11 engages the corresponding pad 54*b* to enable a known soldering operation to apply a solder joint, not shown, that connects the terminal 36 directly to the corresponding pad 54*b*. Said terminal 36 on the input power connector block 11 connects an appropriate neutral wire, not shown, of the input power wiring, not shown, to the connector block 12. The neutral bus 53 extends between the pad 54*b* and another pad 54*c* on the bus 53. The pad 54*c* extends from a top surface of the circuit board 9 to an interior layer, not shown, of the circuit board 9, and extends along the interior layer until joining with the corresponding pads 58 that are connected to the components 56, 57, 58. Although each of the components 56, 57, 58 is connected to the pad 54*c* on the neutral bus 53, the ballast 10 may change to not require each of the components 56, 57, 58 to connect with the neutral bus 53, which would eliminate the need for each component 56, 57, 58 to connect with the pad 54*c***.

With reference to FIGS. 3 and 4, the pads 52, **52*a*, 52*b*, 54 and 54*a* have slightly different shapes, but in other respects are similar in construction. Pads 54*b* and 54*c* are similar in construction. Connection of the terminals 36 to the circuit 13 is accomplished similarly, as described, because the terminals 36** are duplicates of one another.

With reference to FIGS. 3 and 4, another component 59 is a dimmer circuit or an emergency light switch circuit or both a dimmer circuit and an emergency light switch circuit. The dimmer circuit is activated to reduce illumination and consequent consumption of electrical power. The emergency light switch circuit senses interruption of electrical power and automatically switches battery stored energy to maintain illumination. The component 59 is connected on the circuit board 9 to a corresponding pad 52 on the power bus 51 and to corresponding pads **52*a* and 54*a* for connection along the neutral bus 53 between the connector block 12 and the connector block 11**.

The sockets 4, the ballast 10, the internal connector block 12 and the external power connector block 11 are integrated parts of the circuit 13 on the circuit board 9. The circuit board 9 and the circuit 13 can have different constructions to connect the input power connector block 11 with the ballast 10 and the sockets 4 on the circuit board 9. The circuit board 9 and the circuit 13 can have different constructions to connect the ballast 10 between the internal connector block 12 and the power connector block 11.

The integrated circuit 13 is a substantial improvement over an existing ballast 7, for example, as disclosed in U.S. Pat. No. 4,504,891, as being a separate, component part plugged onto a circuit board, either with a cable assembly, or with electrical terminals that plug into a separate connector.

To complete the connector 3, the covers 14, 15 are assembled together forming the housing 16 that encloses the circuit board 9, the circuit 13 and the connector blocks 11, 12. First openings 60 in the housing 16 allow corresponding sockets 4 to be exposed from the housing 16 for plugged connection of fluorescent lamps. A second opening 61 in the housing 16 exposes a portion of the external power connector block 11 to face the opening 49 in the reflector housing 2, FIGS. 2 and 12, for connection to wiring, not shown, for supplying electrical power. A third opening 62 in the housing 16 exposes the ring 46 and the terminal 45 attached to the ring 46 for connection to the reflector housing 2 by the ground screw 47. A fourth opening 63 in the housing 16 exposes a portion of the internal connector block 12 for connection of each insulated wire 5. The housing 16 can be readily changed to adjust the positions of the sockets 4, the internal connector block 12 and the external power connector block 11. For example, the fourth opening 63 can change position to correspond with the position of the internal connector block 12 on the circuit board 9. The internal connector block 12 can be moved from an end of the circuit board 9, as shown in FIG. 3, to a position in the center of the circuit board 9, between two sockets 4, as shown in FIGS. 2 and 12.

Although the embodiment has been described with two sockets 4, additional sockets 4 can be added, for example, to provide a bank of three sockets 4, and a bank of four sockets 4, merely by a lengthened connector 1 and by selecting different components and by sizing the components, such as the components 56, 57, and 58, of the electronic ballast 10. Although the components 56, 57, and 58 are shown as flat areas, they can also be of different heights and widths as required for sizing the components. The components are adapted to fit within the interior space of the housing 16, and for distribution among the sockets 4 and the connector blocks 11, 12 within the housing 16. Other modifications and embodiments of the invention are intended to be covered by the spirit and scope of the appended claims.

An advantage of the invention resides in an electrical connector for a fluorescent lighting comprising: an integrated circuit on a circuit board interconnecting a bank of sockets for fluorescent lamps, and wire connecting ports for connecting the circuit board between wiring supplying electrical power and wiring extending to a second bank of sockets for fluorescent lamps, and a housing enclosing the integrated circuit, and the integrated circuit comprising; a lamp ballast and a power bus and a neutral bus.

Other embodiments and modifications are intended to be covered by the spirit and scope of the appended claims.

We claim:

1. An electrical connector comprising:

a first bank of sockets for fluorescent lamps, a lamp ballast for the first bank of sockets, wire connecting ports adapted to connect the first bank of sockets and the ballast between external wiring from a source of electrical power and wiring extending to a second bank of sockets for the fluorescent lamps, a circuit board integrating the first bank of sockets, the ballast and the wire connecting ports, and a housing covering the ballast and the wire connecting ports and the circuit board, with the first bank of sockets being exposed from the housing for connection to the fluorescent lamps, and with the wire connecting ports being exposed from the housing for connection between the external wiring and the wiring extending to the second bank of sockets.

2. An electrical connector as recited in claim 1, wherein the ballast comprises semiconductor devices mounted on the circuit board.

3. An electrical connector as recited in claim 1, further comprising a wire engaging contact in one of said wire connecting ports for attaching a single wire of said wiring extending to said second bank of sockets.

4. An electrical connector as recited in claim 1, further comprising an electrical circuit on the circuit board interconnecting the ballast with the first bank of sockets and with the wire connecting ports.

5. An electrical connector as recited in claim 1, further comprising openings in the housing for access to the wire connecting ports.

6. An electrical connector as recited in claim 1, further comprising a dimmer control circuit on the circuit board, and an electrical circuit on the circuit board connecting the dimmer control circuit with the firs% bank of sockets.

7. An electrical connector as recited in claim 1, further comprising an emergency light switch circuit on the circuit board, and an electrical circuit on the circuit board connecting the emergency light switch circuit with the first bank of sockets.

8. An electrical connector as recited in claim 1, further comprising a dimmer control circuit on the circuit board, an emergency light switch circuit on the circuit board, and an electrical circuit on the circuit board connecting the dimmer control circuit and the emergency light switch circuit with the first bank of sockets.

9. An electrical connector as recited on claim 1, further comprising a power bus and a ground bus on the circuit board interconnecting the first bank of sockets and the wire connecting ports, and the ballast being connected to the power bus and to electrical ground on the circuit board.

10. An electrical connector as recited in claim 1, further comprising a ground terminal on one of the wire connecting ports projecting from the housing for connection to a fluorescent lighting fixture.

11. A fluorescent lighting fixture comprising:

a reflector housing, an electrical connector for mounting to one side of the reflector housing, a first bank of fluorescent lamp sockets on the connector, a second bank of fluorescent lamp sockets on an opposite side of the reflector housing, at least one insulated wire interconnecting the first and second banks of sockets, and the electrical connector further comprising:

a lamp ballast for said first bank of sockets, wire connecting ports adapted to connect the first bank of sockets and the ballast between external wiring from a source of electrical power and said insulated wire interconnecting the first and second banks of sockets, a circuit board integrating the first bank of sockets, the ballast and the wire connecting ports, and a housing covering the ballast and the wire connecting ports and the circuit board, with the first bank of sockets being exposed from the housing for connection to fluorescent lamps, and with the wire connecting ports being exposed from the housing for connection between the external wiring and said insulated wire interconnecting the first and second banks of sockets.

12. A fluorescent lighting fixture as recited in claim 11, wherein the ballast comprises semiconductor devices mounted on the circuit board.

13. A fluorescent lighting fixture as recited in claim 11, further comprising a wire engaging contact in one of said wire connecting ports for attaching said at least one insulated wire.

14. A fluorescent lighting fixture as recited in claim 11, further comprising an electrical circuit on the circuit board interconnecting the ballast with the first bank of sockets and with the wire connecting ports.

15. A fluorescent lighting fixture as recited in claim 11, further comprising openings in the housing for access to the wire connecting ports.

16. A fluorescent lighting fixture as recited in claim 11, further comprising a dimmer control circuit on the circuit board, and an electrical circuit on the circuit board connecting the dimmer control circuit with the first bank of sockets.

17. A fluorescent lighting fixture as recited in claim 11, further comprising an emergency light switch circuit on the circuit board, and an electrical circuit on the circuit board connecting the emergency light switch circuit with the first bank of sockets.

18. A fluorescent lighting fixture as recited in claim 11, further comprising a dimmer control circuit on the circuit board, an emergency light switch circuit on the circuit board, and an electrical circuit on the circuit board connecting the dimmer control circuit and the emergency light switch circuit with the first bank of sockets.

19. A fluorescent lighting fixture as recited in claim 11, further comprising a power bus and a ground bus on the circuit board interconnecting the first bank of sockets and the wire connecting ports, and the ballast being connected to the power bus and to electrical ground on the circuit board.

20. An electrical connector for a fluorescent lighting fixture comprising:

an integrated circuit on a circuit board interconnecting a first bank of sockets for fluorescent lamps, and wire connecting ports for connecting the circuit board between wiring supplying electrical power and wiring extending to a second bank of sockets for the fluorescent lamps, and a housing enclosing the integrated circuit, and the integrated circuit comprising: a lamp ballast and a power bus and a ground bus.

21. An electrical connector comprising:

a circuit board having an integral lamp ballast;

a first bank of sockets for fluorescent lamps, each of the sockets including a respective terminal electrically connected to the circuit board;

wire connecting ports mounted on the circuit board; and a housing covering the ballast and the circuit board, with the first bank of sockets being exposed from the housing for connection to the fluorescent lamps, and the wire connecting ports being exposed from the housing for termination to an external conductor from a source of electrical power and wiring to a second bank of sockets for the fluorescent lamps.

22. The electrical connector according to claim 21, wherein the first bank of sockets are mounted directly on the circuit board.

* * * * *